US008412077B2

(12) United States Patent
Ishiguro et al.

(10) Patent No.: US 8,412,077 B2
(45) Date of Patent: Apr. 2, 2013

(54) DEVELOPING DEVICE AND IMAGE FORMING APPARATUS USING THE SAME

(75) Inventors: Yasuyuki Ishiguro, Osaka (JP); Koichi Mihara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 366 days.

(21) Appl. No.: 12/791,039

(22) Filed: Jun. 1, 2010

(65) Prior Publication Data

US 2010/0322670 A1 Dec. 23, 2010

(30) Foreign Application Priority Data

Jun. 22, 2009 (JP) ..... 2009-147635

(51) Int. Cl.
*G03G 15/08* (2006.01)

(52) U.S. Cl. ..... 399/254

(58) Field of Classification Search ..... 399/254, 399/255, 256, 260
See application file for complete search history.

(56) References Cited

U.S. PATENT DOCUMENTS

| | | | | |
|---|---|---|---|---|
| 5,943,537 | A * | 8/1999 | Ahn | 399/254 |
| 6,615,014 | B2 | 9/2003 | Sugihara | |
| 7,167,667 | B2 * | 1/2007 | Mabuchi | 399/255 |
| 7,471,920 | B2 * | 12/2008 | Akedo | 399/254 |
| 7,493,069 | B2 * | 2/2009 | Akedo | 399/255 |
| 2006/0204283 | A1 * | 9/2006 | Yasuda | 399/254 |
| 2007/0166079 | A1 * | 7/2007 | Ichikawa et al. | 399/254 |

FOREIGN PATENT DOCUMENTS

| | | |
|---|---|---|
| JP | 5-57993 | 3/1993 |
| JP | 2001-255723 | 9/2001 |
| JP | 2006-267204 | 10/2006 |
| JP | 2009-98595 | 5/2009 |

* cited by examiner

*Primary Examiner* — Sandra Brase
(74) *Attorney, Agent, or Firm* — Birch, Stewart, Kolasch & Birch, LLP

(57) ABSTRACT

The developing device includes: a developing container for storing a developer; first and second conveying passages that are formed in the developing container and sectioned by a partition; first and second conveying members disposed inside the first and second conveying passages, respectively, to agitate and circulatively convey the developer through the first and second conveying passages in opposite directions; a developing roller that supplies the developer in the second developer conveying passage to a photoreceptor drum; first and second communication paths that connect between the first and second conveying passages at both ends of the partition; and, a developer flow regulator that regulates the flow of developer moving from the first conveying passage to the second conveying passage, in accordance with the height of the developer surface of the developer.

5 Claims, 9 Drawing Sheets

DEVELOPING DEVICE AND IMAGE FORMING APPARATUS USING THE SAME

This Nonprovisional application claims priority under 35 U.S.C. §119(a) on Patent Application No. 2009-147635 filed in Japan on 22 Jun. 2009, the entire contents of which are hereby incorporated by reference.

BACKGROUND OF THE INVENTION (1) Field of the Invention

The present invention relates to a developing device and an image forming apparatus using the device, in particular relating to a developing device using a dual-component developer containing a toner and a magnetic carrier, for use in an image forming apparatus for forming images using the toner based on electrophotography, such as an electrostatic copier, laser printer, facsimile machine or the like, as well as relating to an image forming apparatus using this device.

(2) Description of the Prior Art

Conventionally, image forming apparatuses based on electrophotography such as copiers, printers, facsimile machines and the like have been known. The image forming apparatus using electrophotography is constructed so as to form an image by forming an electrostatic latent image on the surface of a photoreceptor drum, for example, supplying toner to the photoreceptor drum from a developing device to develop the electrostatic latent image, transferring the toner image formed on the photoreceptor drum by development to a sheet of paper or the like, and fixing the toner image onto the sheet by means of a fixing device.

Recently, in the image forming apparatuses supporting full-color and high-quality images, a dual-component developer (which will be referred to hereinbelow simply as "developer"), which can present excellent charge performance stability, is often used.

This developer consists of a toner and a carrier, which are agitated in the developing device and frictionally rubbed with each other to produce suitably electrified toner.

The toner electrified in the developing device is supplied to the surface of a dual-component developer supporting member, e.g., a developing roller. The toner thus supplied to the developing roller is moved by electrostatic attraction to the electrostatic latent image formed on the photoreceptor drum. Hereby, a toner image based on the electrostatic latent image is formed on the photoreceptor drum.

Recently, the image forming apparatus of this kind is demanded to be made compact and operate at high speeds, and it is also necessary to electrify the developer quickly and sufficiently and convey the developer quickly and smoothly.

To deal with such demands, a developing device of a circulating mechanism has been adopted in the image forming apparatus in order to disperse added toner promptly into the developer and provide the toner with a suitable amount of charge. This circulating type developing device includes a developer conveying passages through which the developer is circulatively conveyed and auger screws (developer agitators) that agitate the developer while conveying the developer in the developer passages. In this arrangement, when the toner concentration in the developer becomes lower than a predetermined level, toner is added from the toner hopper to the developer conveying passage, and the added toner is agitated with the developer whilst being conveyed (see patent document 1: Japanese Patent Application Laid-open 2001-255723).

However, in the developing device that circulatively conveys the developer whilst agitating as shown in patent document 1, if the height of the top surface of the developer (which will be referred to hereinbelow as "the developer surface") varies along the longitudinal direction of the developing device, the amount of the developer being drawn up by the developing roller (the amount of the developer supplied to the photoreceptor drum) fluctuates, causing the problem of image density unevenness along the longitudinal direction of the developing roller.

Further, when toner is newly added to the developer, the developer presents local variations in toner concentration and in the amount of static charge on the toner, which readily cause change in the volume density of the developer and variation in the developer surface. In particular, in the developing device of a circulative conveying type, since no conveying member such as an auger screw or the like is disposed at the communication path from one developer conveying passage to the other, the developer, if it is poor in fluidity, is prone to stagnate, triggering marked rise of the developer surface.

SUMMARY OF THE INVENTION

The present invention has been devised in view of the above conventional problem, it is therefore an object of the present invention to provide a developing device in which stagnation of the developer at communication paths between the developer conveying passages can be prevented so as to reduce the rise of the developer surface.

The developing device according to the present invention for solving the above problem and the image forming apparatus using this device are configured as follows:

The first aspect of the present invention resides in a developing device comprising: a developing container for storing a developer comprising a toner and a magnetic carrier; first and second conveying passages that are formed in the developing container and sectioned by a partition; first and second conveying members disposed inside the first and second conveying passages, respectively, to agitate and circulatively convey the developer inside the first and second conveying passages in opposite directions; a developing roller that supplies the toner contained in the developer in the second developer conveying passage to a photoreceptor drum; first and second communication paths that connect between the first and second conveying passages at both ends of the partition; and, a developer flow regulator that regulates the flow of developer from the first conveying passage to the second conveying passage or the flow of developer from the second conveying passage to the first conveying passage, in accordance with the height of the developer surface of the developer.

The second aspect of the present invention is characterized in that the developer flow regulator comprises: an upper opening formed in the upper part at the end of the partition; a shutter member that opens and closes the upper opening, being adapted to change the size of the opening of the first communication path and/or second communication path, depending on the positioning thereof; and, a supporter for pivotally supporting the shutter member, the shutter member comprises: a shutter plate that opens and closes the upper opening; a shutter member rotary shaft that is pivotally supported and axially supports the shutter plate; and a shutter shifting plate that receives the flow of developer to shift the position of the shutter, the shutter plate is arranged radially from the shutter member rotary shaft, and, the shutter shifting plate is arranged radially from the shutter member rotary shaft so as to form an angle of 90 to 170 degrees with the shutter plate.

The third aspect of the present invention is characterized in that the supporter is disposed at the end of the partition.

The fourth aspect of the present invention is characterized in that the developer flow regulator includes: a spring that urges the shutter plate in such a direction as to close the upper opening; and, a stopper for limiting the movable range of the shutter plate.

The fifth aspect of the present invention resides in an image forming apparatus for forming images with toner based on electrophotography, comprising: a photoreceptor drum for forming an electrostatic latent image on the surface thereof; a charging device for electrifying the surface of the photoreceptor drum; an exposure device for forming an electrostatic latent image on the photoreceptor drum surface; a developing device for forming a toner image by supplying toner to the electrostatic latent image on the photoreceptor drum surface; a transfer device for transferring the toner image to a recording medium; and, a fixing device for fixing the transferred toner image to the recording medium, and is characterized in that a developing device according to any one of the first to fourth aspects is used as the developing device.

According to the first aspect of the present invention, when the height of the developer surface rises locally, the flow of developer between the first and second conveying passages can be increased by means of the developer flow regulator. Accordingly, it is possible to inhibit stagnation of the developer around the first or second communication path and hence reduce the rise of the developer surface.

According to the second aspect of the present invention, it is possible to easily regulate the flow of developer by flowing the developer from the upper opening into the second conveying passage by releasing the shutter plate when the developer surface has risen. As a result, it is possible to reduce the rise of the developer surface with a simple structure.

According to the third aspect of the present invention, since the shutter member is arranged at the end of the partition where the developer surface is most likely to rise, it is possible to perceive variation of the developer surface promptly and release the shutter member.

According to the fourth aspect of the present invention, gradual opening of the shutter plate opposing the repulsive force of the spring in accordance with the flow of developer, makes it possible for the developer to flow out, and provision of the stopper makes it possible to prevent the shutter plate from being excessively opened.

Specifically, since the shutter shifting plate is moved by the pressure from the developer that flows the developer conveying passage (the first conveying passage), the higher the height of the developer surface, the greater the force to open the shutter plate. Accordingly, it is possible to finely regulate the size of opening of the shutter plate depending on the height of the developer surface, by adjusting the spring constant of the spring to an appropriate value. As a result, a large amount of developer flows to the second conveying passage when the developer surface is higher than a certain level, and the flow of developer gradually lowers as the developer surface gradually lowers, so that it is possible to prevent over-regulation of the developer surface.

According to the fifth aspect of the present invention, since it is possible to inhibit variation of the developer surface in the developer conveying passage in the developing device, it is possible to obtain images free from image density unevenness.

DESCRIPTION OF THE PREFERRED EMBODIMENTS

Now, the embodied mode for carrying out the present invention will be described with reference to the drawings.

Figure 1:
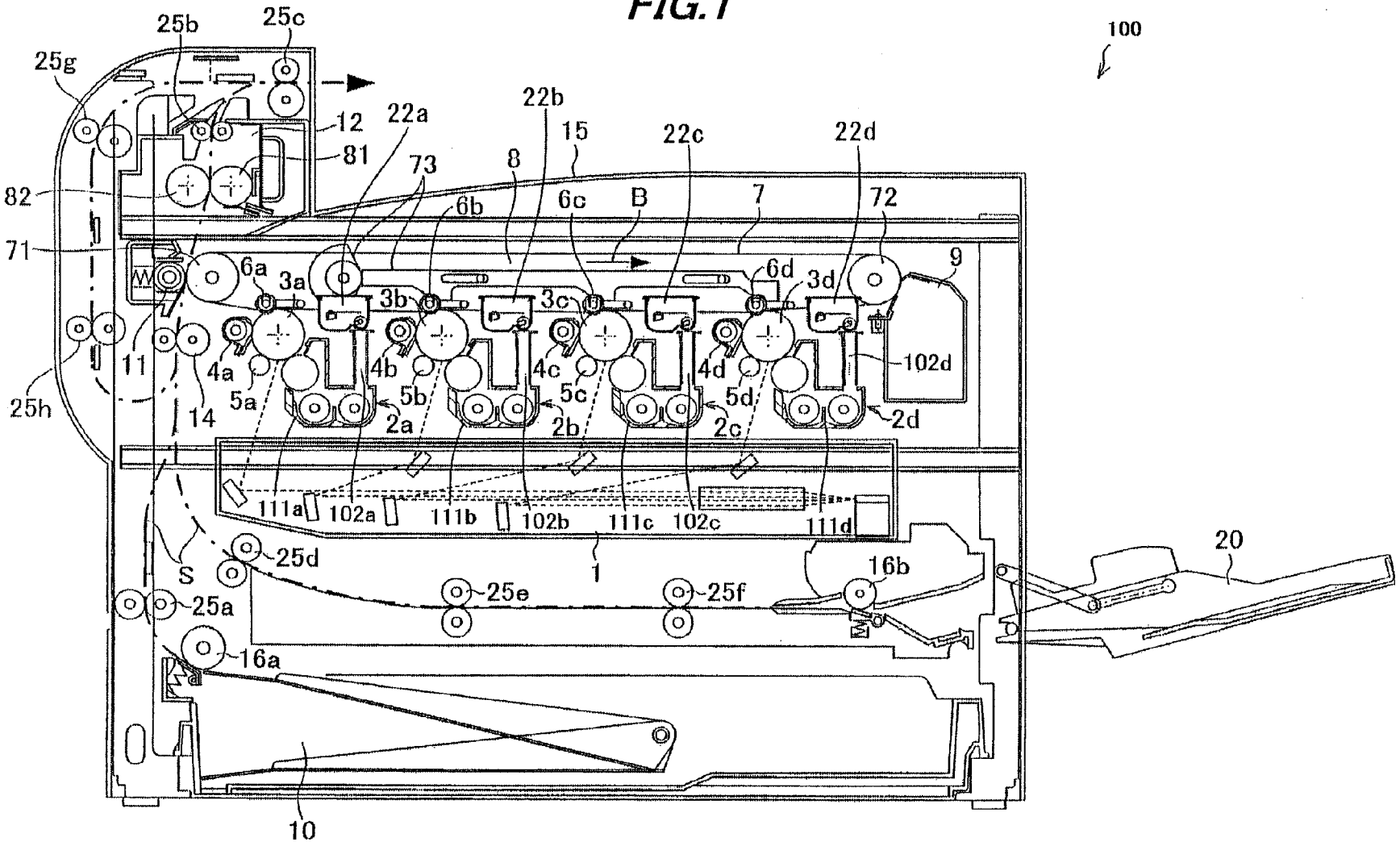
FIG. 1 is an illustrative view showing the overall configuration of an image forming apparatus including a developing device according to the embodiment of the present invention.

FIG. 1 shows one exemplary embodiment of the present invention, and is an illustrative view showing the overall configuration of an image forming apparatus including a developing device according to the embodiment of the present invention.

An image forming apparatus 100 of the present embodiment forms an image with toners based on electrophotography, including: as shown in FIG. 1, photoreceptor drums 3*a*, 3*b*, 3*c* and 3*d* (which may be also called "photoreceptor drums 3" when general mention is made) for forming electrostatic latent images on the surfaces thereof; chargers (charging devices) 5*a*, 5*b*, 5*c* and 5*d* (which may be also called "chargers 5" when general mention is made) for charging the surfaces of photoreceptor drums 3; an exposure unit (exposure device) 1 for forming electrostatic latent images on the photoreceptor drum 3 surfaces; developing devices 2*a*, 2*b*, 2*c* and 2*d* (which may be also called "developing devices 2" when general mention is made) for supplying toners to the electrostatic latent images on the photoreceptor drum 3 surfaces to form toner images; toner supply devices 22*a*, 22*b*, 22*c* and 22*d* (which may be also called "toner supply devices 22" when general mention is made) for supplying toners to developing devices 2; an intermediate transfer belt unit (transfer device) 8 for transferring the toner images from the photoreceptor drum 3 surfaces to a recording medium; and a fixing unit (fixing device) 12 for fixing the toner image to the recording medium.

This image forming apparatus 100 forms a multi-color or monochrome image on a predetermined sheet (recording paper, recording medium) in accordance with image data transmitted from the outside. Here, image forming apparatus 100 may also include a scanner or the like for reading original images, on the top thereof.

To being with, the overall configuration of image forming apparatus 100 will be described.

As shown in FIG. 1, image forming apparatus 100 separately handles image data of individual color components, i.e., black (K), cyan (C), magenta (M) and yellow (Y), and forms black, cyan, magenta and yellow images, superimposes these images of different color components to produce a full-color image.

Accordingly, image forming apparatus 100 includes, as shown in FIG. 1, four developing devices 2 (2*a*, 2*b*, 2*c* and 2*d*), four photoreceptor drums 3 (3*a*, 3*b*, 3*c* and 3*d*), four chargers 5 (5*a*, 5*b*, 5*c* and 5*d*) and four cleaner units 4 (4*a*, 4*b*, 4*c* and 4*d*) to form images of the four different colors. In other words, four image forming stations (image forming portions) each including one developing device 2, one photoreceptor drum 3, one charger 5 and one cleaner unit 4 are provided.

Here, the symbols a to d are used so that 'a' represents the components for forming black images, 'b' the components for forming cyan images, 'c' the components for forming magenta images and 'd' the components for forming yellow images. Image forming apparatus 100 includes exposure unit 1, fixing unit 12, a sheet conveyor system S and a paper feed tray 10 and a paper output tray 15.

Charger 5 electrifies the photoreceptor drum 3 surface at a predetermined potential.

As charger 5, other than the contact roller-type charger shown in FIG. 1, a contact brush-type charger, a non-contact type discharging type charger and others may be used.

Exposure unit 1 is a laser scanning unit (LSU) including a laser emitter and reflection mirrors as shown in FIG. 1. Other than the laser scanning unit, arrays of light emitting elements such as EL (electroluminescence) and LED writing heads, may be also used as exposure unit 1. Exposure unit 1 illuminates the photoreceptor drums 3 that have been electrified, in accordance with input image data so as to form electrostatic latent images corresponding to the image data on the surfaces of photoreceptor drums 3.

Developing device 2 (2*a*, 2*b*, 2*c* or 2*d*) visualizes (develops) the electrostatic latent image formed on photoreceptor drum 3 with toner of K, C, M or Y. Arranged over developing devices 2 are toner transport mechanisms 102*a*, 102*b*, 102*c* and 102*d* (which may also be called "toner transport mechanisms 102 when general mention is made), toner supply devices 22*a*, 22*b*, 22*c* and 22*d* (which may also be called "toner supply devices 22 when general mention is made) and developing containers 111*a*, 111*b*, 111*c* and 111*d* (which may also be called "developer containers 111 when general mention is made).

Toner supply device 22 is arranged on the upper side of developing container 111 and stores unused toner (powder toner). This toner is supplied from toner supply device 22 to developing container 111 by means of toner transport mechanism 102.

Cleaner unit 4 removes and collects the toner remaining on the photoreceptor drum 3 surface after development and image transfer stages.

Arranged over photoreceptor drums 3 is an intermediate transfer belt unit 8. Intermediate transfer belt unit 8 includes intermediate transfer rollers 6 (6*a*, 6*b*, 6*c* and 6*d*), an intermediate transfer belt 7, an intermediate transfer belt drive roller 71, an intermediate transfer belt driven roller 72, an intermediate transfer belt tensioning mechanism 73 and an intermediate transfer belt cleaning unit 9.

Intermediate transfer rollers 6, intermediate transfer belt drive roller 71, intermediate transfer belt driven roller 72 and intermediate transfer belt tensioning mechanism 73 support and stretch intermediate transfer belt 7 to circulatively drive intermediate transfer belt 7 in the direction of an arrow B in FIG. 1.

Intermediate transfer rollers 6 are rotatably supported at intermediate transfer roller fitting portions in intermediate transfer belt tensioning mechanism 73 of intermediate transfer belt unit 8. Applied to each intermediate transfer roller 6 is a transfer bias for transferring the toner image from photoreceptor drum 3 to intermediate transfer belt 7.

Intermediate transfer belt 7 is arranged so as to be in contact with each photoreceptor drum 3. The toner images of different color components formed on photoreceptor drums 3 are successively transferred one over another to intermediate transfer belt 7 so as to form a full-color toner image (multicolor toner image). This intermediate transfer belt 7 is formed of an endless film of about 100 to 150 μm thick, for instance.

Transfer of the toner image from photoreceptor drum 3 to intermediate transfer belt 7 is effected by intermediate transfer roller 6 which is in contact with the interior side of intermediate transfer belt 7. A high-voltage transfer bias (a high voltage of a polarity (+) opposite to the polarity (−) of the electrostatic charge on the toner) is applied to each intermediate transfer roller 6 in order to transfer the toner image.

Intermediate transfer roller 6 is composed of a shaft formed of metal (e.g., stainless steel) having a diameter of 8 to 10 mm and a conductive elastic material (e.g., EPDM, foamed urethane, etc.,) coated on the shaft surface. Use of this conductive elastic material enables intermediate transfer roller 6 to uniformly apply high voltage to intermediate transfer belt 7. Though in the present embodiment, roller-shaped elements (intermediate transfer rollers 6) are used as the transfer electrodes, brushes etc. can also be used in their place.

The electrostatic latent image formed on each of photoreceptor drums 3 is developed as described above with the toner associated with its color component into a visual toner image. These toner images are laminated on intermediate transfer belt 7, laying one image over another. The thus formed lamination of toner images is moved by rotation of intermediate transfer belt 7 to the contact position (transfer position) between the conveyed paper and intermediate transfer belt 7, and is transferred to the paper by a transfer roller 11 arranged at that position. In this case, intermediate transfer belt 7 and transfer roller 11 are pressed against each other forming a predetermined nip while a voltage for transferring the toner image to the paper is applied to transfer roller 11. This voltage is a high voltage of a polarity (+) opposite to the polarity (−) of the electrostatic charge on the toner.

In order to keep the aforementioned nip constant, either transfer roller 11 or intermediate transfer belt drive roller 71 is formed of a hard material such as metal or the like while the other is formed of a soft material such as an elastic roller or the like (elastic rubber roller, foamed resin roller etc.).

Of the toner adhering to intermediate transfer belt 7 as the belt comes in contact with photoreceptor drums 3, the toner which has not been transferred from intermediate transfer belt 7 to the paper during transfer of the toner image and remains on intermediate transfer belt 7 would cause contamination of color toners at the next operation, hence is removed and collected by an intermediate transfer belt cleaning unit 9.

Intermediate transfer belt cleaning unit 9 includes a cleaning blade (cleaning member) that is put in contact with intermediate transfer belt 7. Intermediate transfer belt 7 is supported from its interior side by intermediate transfer belt driven roller 72, at the area where this cleaning blade is put in contact with intermediate transfer belt 7.

Paper feed tray 10 is to stack sheets (e.g., recording paper) to be used for image forming and is disposed under the image forming portion and exposure unit 1. On the other hand, paper output tray 15 disposed at the top of image forming apparatus 100 stacks printed sheets with the printed face down.

Image forming apparatus 100 also includes sheet conveyor system S for guiding sheets from paper feed tray 10 and from a manual feed tray 20 to paper output tray 15 by way of the transfer portion and fixing unit 12. Here, the transfer portion is located between intermediate transfer belt drive roller 71 and transfer roller 11.

Arranged along sheet conveyor system S are pickup rollers 16 (16*a*, 16*b*), a registration roller 14, the transfer portion, fixing unit 12 and feed rollers 25 (25*a* to 25*h*) and the like.

Feed rollers 25 are a plurality of small-diametric rollers arranged along sheet conveyor system S to promote and assist sheet conveyance. Pickup roller 16*a* is a roller disposed at the end of paper feed tray 10 for picking up and supplying the paper one sheet at a time from paper feed tray 10 to sheet conveyor system S. Pickup roller 16*b* is a roller disposed at the vicinity of manual feed tray 20 for picking up and supplying the paper, one sheet at a time, from manual feed tray 20 to sheet conveyor system S. Registration roller 14 temporarily suspends the sheet being conveyed on sheet conveyor system S and delivers the sheet to the transfer portion at such timing that the front end of the sheet meets the front end of the image data area on intermediate transfer belt 7.

Fixing unit 12 includes a heat roller 81, a pressing roller 82 and the like. These heat roller 81 and pressing roller 82 rotate while nipping the sheet therebetween. Heat roller 81 is controlled by a controller (not shown) so as to keep a predetermined fixing temperature. This controller controls the temperature of heat roller 81 based on the detection signal from a temperature detector (not shown).

Heat roller 81 fuses, mixes and presses the lamination of color toner images transferred on the sheet by thermally pressing the sheet with pressing roller 82 so as to thermally fix the toner onto the sheet. The sheet with a multi-color toner image (individual color toner images) fixed thereon is conveyed by plural feed rollers 25 to the inversion paper discharge path of sheet conveyor system S and discharged onto paper output tray 15 in an inverted position (with the multi-color toner image placed facedown).

Next, the operation of sheet conveyance by sheet conveyor system S will be described.

As shown in FIG. 1, image forming apparatus 100 includes, as mentioned above, paper feed tray 10 that stacks sheets beforehand and manual feed tray 20 that is used when a few pages are printed out. Each tray is provided with pickup roller 16 (16*a*, 16*b*) so that these pickup rollers 16 supply the paper one sheet at a time to sheet conveyor system S.

In the case of one-sided printing, the sheet fed from paper feed tray 10 is conveyed by feed roller 25*a* in sheet conveyor system S to registration roller 14 and delivered to the transfer portion (the contact position between transfer roller 11 and intermediate transfer belt 7) by registration roller 14 at such timing that the front end of the sheet meets the front end of the laminated toner image on intermediate transfer belt 7. At the transfer portion, the toner image is transferred onto the sheet. Then, this toner image is fixed onto the sheet by fixing unit 12. Thereafter, the sheet passes through feed roller 25*b* to be discharged by paper output roller 25*c* onto paper output tray 15.

Also, the sheet fed from manual feed tray 20 is conveyed by plural feed rollers 25 (25*f*, 25*e* and 25*d*) to registration roller 14. From this point, the sheet is conveyed and discharged to paper output tray 15 through the same path as that of the sheet fed from the aforementioned paper feed tray 10.

On the other hand, in the case of dual-sided printing, the sheet which has been printed on the first side and passed through fixing unit 12 as described above is nipped at its rear end by paper discharge roller 25*c*. Then the paper discharge roller 25*c* is rotated in reverse so that the sheet is guided to feed rollers 25*g* and 25*h*, and conveyed again through registration roller 14 so that the sheet is printed on its rear side and then discharged to paper output tray 15.

Next, the configuration of toner supply device 22 of the present embodiment will be specifically described.

Figure 2:
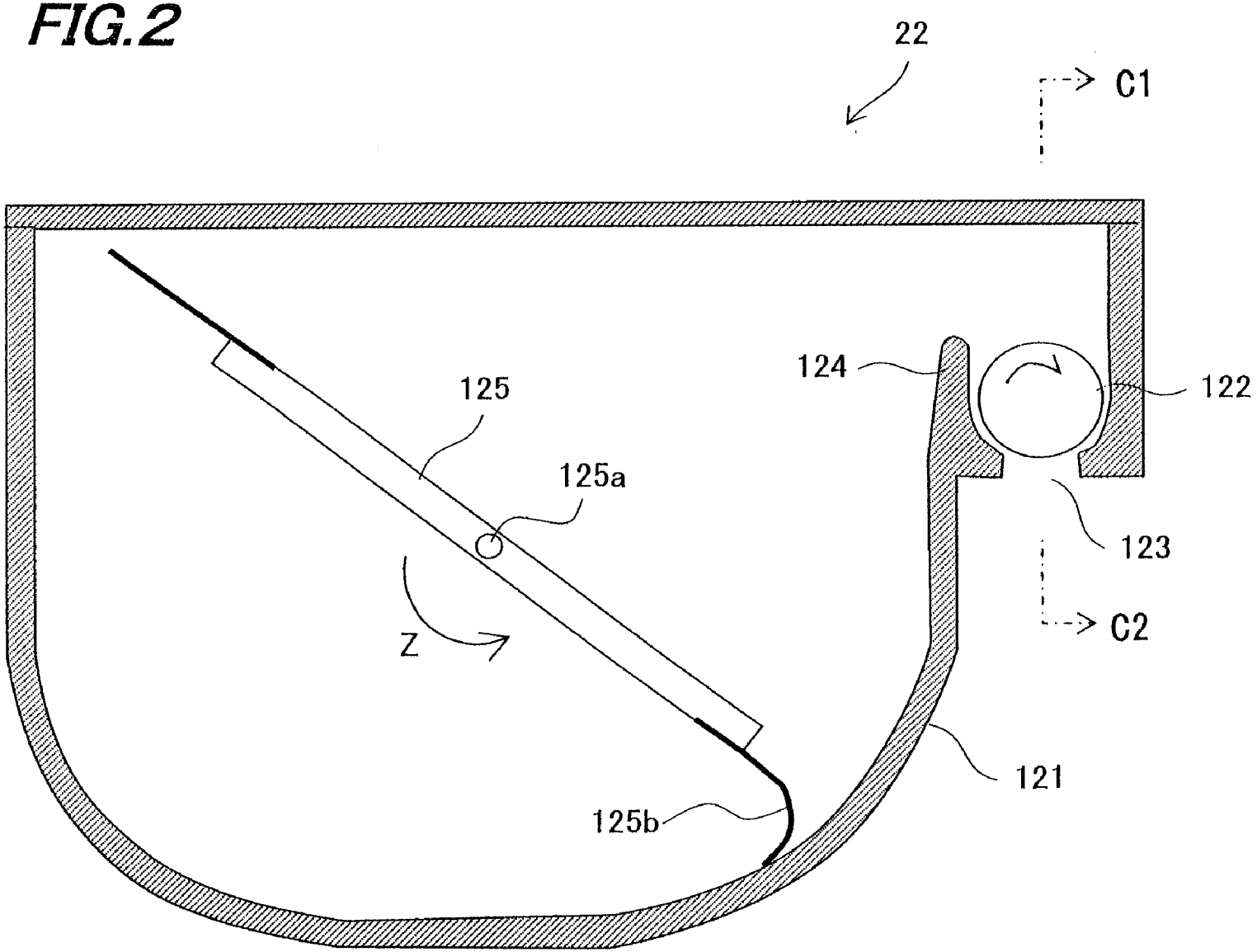
FIG. 2 is a sectional view showing the schematic configuration of a toner supply device that constitutes the image forming apparatus.
Figure 3:
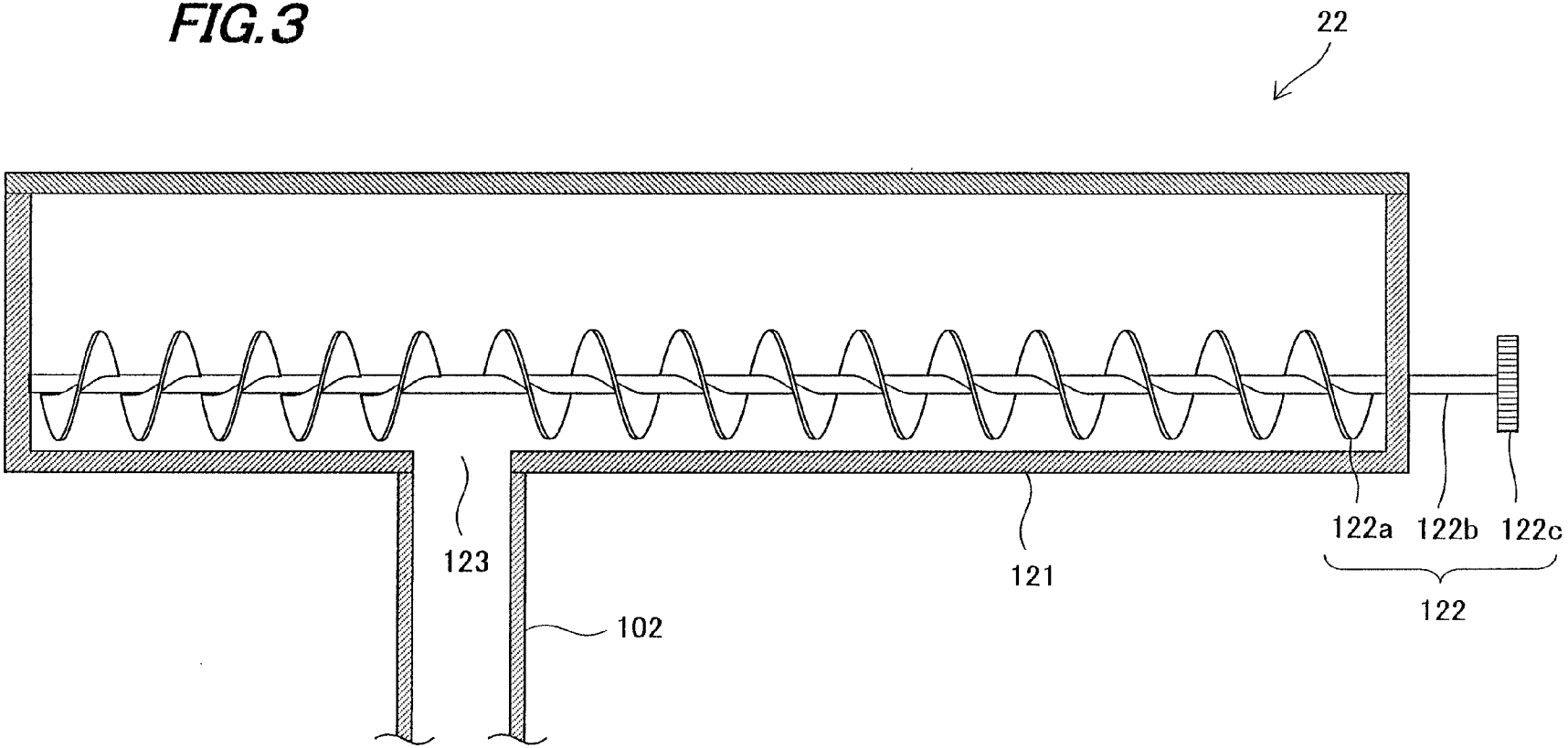
FIG. 3 is a sectional view cut along a plane C1-C2 in FIG. 2.

FIG. 2 is a sectional view showing the schematic configuration of the toner supply device that constitutes the image forming apparatus according to the present embodiment. FIG. 3 is a sectional view cut along a plane C1-C2 in FIG. 2.

As shown in FIG. 2, toner supply device 22 includes a toner storing container 121, a toner agitator 125, a toner discharger 122 and a toner discharge port 123. Toner supply device 22 is arranged on the upper side of developing container 111 and stores unused toner (powder toner). As shown in FIG. 3, the toner in toner supply device 22 is supplied from toner discharge port 123 to developing container 111 by means of toner transport mechanism 102 as toner discharger (discharging screw) 122 is rotated.

Toner storing container 121 is a container part having a substantially semicylindrical configuration with a hollow interior, rotationally supporting toner agitator 125 and toner discharger 122 to store toner. As shown in FIG. 3, toner discharge port 123 is a substantially rectangular opening disposed under toner discharger 122 and positioned near to the center with respect to the axial direction of toner discharger 122 and connected to toner transport mechanism 102.

Toner agitator 125 is a plate-like part that rotates about a rotary axis 125*a* and draws up and conveys the toner stored inside toner storing container 121 toward toner discharger 122 whilst agitating the toner stored in toner storing container 121. Toner agitator 125 has a toner scooping part 125*b* extended along rotary axis 125*a* at either end. Toner scooping part 125*b* is formed of a polyethylene terephthalate (PET) sheet having flexibility and is attached to each of the longitudinal sides of toner agitator 125 that are parallel to rotary axis 125*a*.

Toner discharger 122 dispenses the toner in toner storing container 121 from toner discharge port 123 to developing container 111. Toner discharger 122 is formed of an auger screw of a toner conveyor blade 122*a* and a toner discharger rotary shaft 122*b* and a toner discharger rotating gear 122*c*, as shown in FIG. 3. Toner discharger 122 is rotationally driven by an unillustrated toner discharger drive motor. As to the helix direction of the auger screw, toner conveyor blade 122*a* is designed so that toner can be conveyed from both ends of toner discharger 122 toward toner discharge port 123 with respect to the axial direction of toner discharger 122.

Provided between toner discharger 122 and toner agitator 125 is a toner discharger partitioning wall 124 (FIG. 2). This wall makes it possible to keep and hold the toner scooped by toner agitator 125 in a suitable amount around toner discharger 122.

As shown in FIG. 2, toner agitator 125 rotates in the direction of arrow Z to agitate and scoop up the toner toward toner discharger 122. In this action, toner scooping parts 125*b* rotate as they are deforming and sliding along the interior wall of toner storing container 121 due to the flexibility thereof, to thereby supply the toner toward the toner discharger 122 side. Then, toner discharger 122 turns so as to lead the scooped toner to toner discharge port 123.

Next, the configuration of developing device 2 will be described with reference to the drawings.

Figure 4:
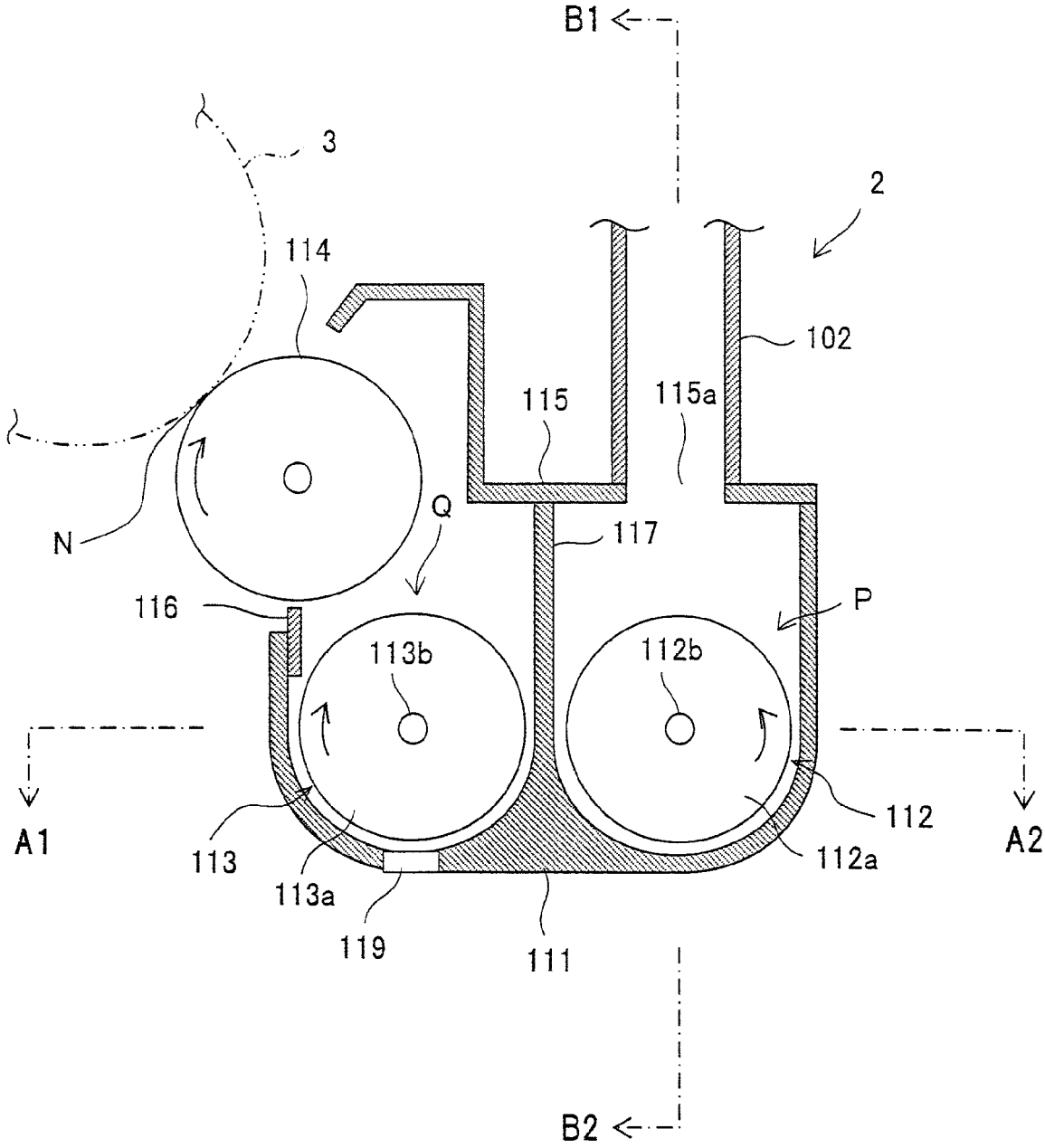
FIG. 4 is a sectional view showing the configuration of a developing device that constitutes the image forming apparatus.
Figure 5:
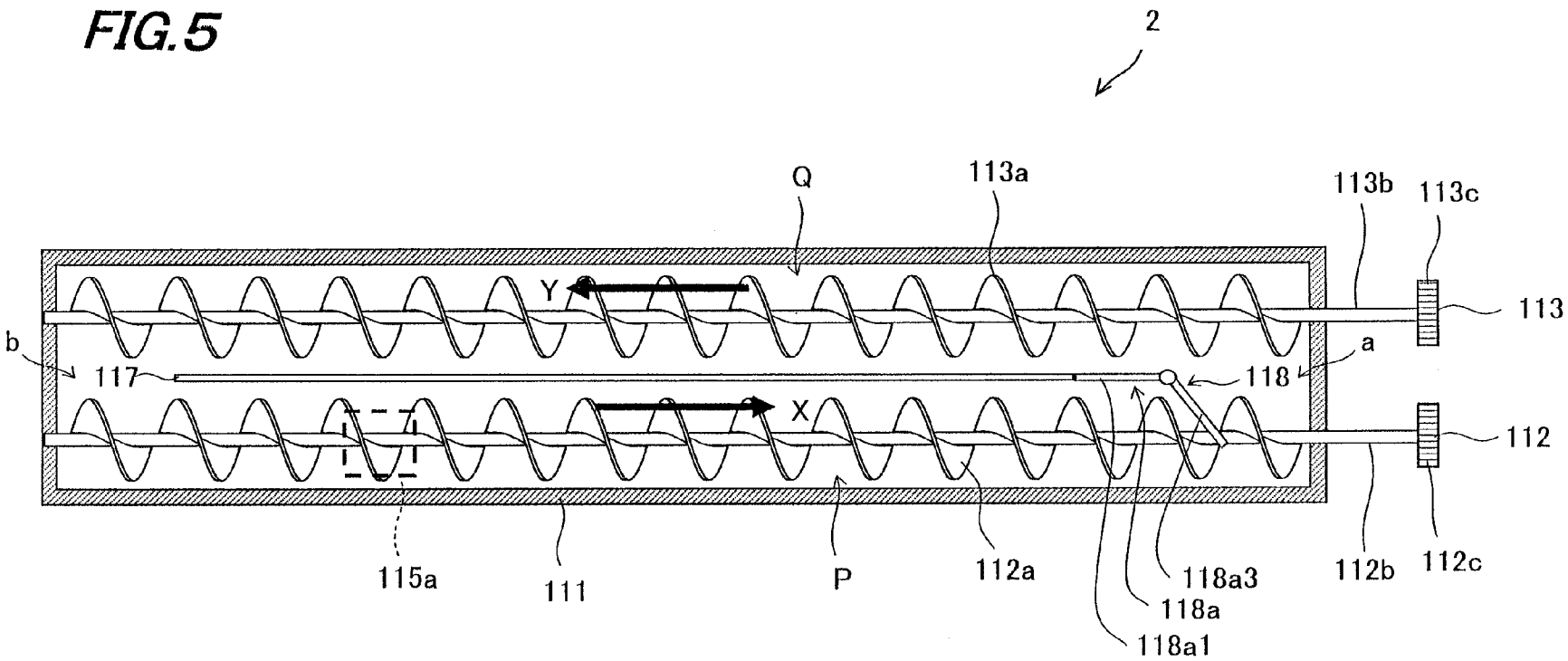
FIG. 5 is a sectional view cut along a plane A1-A2 in FIG. 4, for explaining a shutter member of a developer flow regulator as apart of the developing device when the shutter member is closed.
Figure 6:
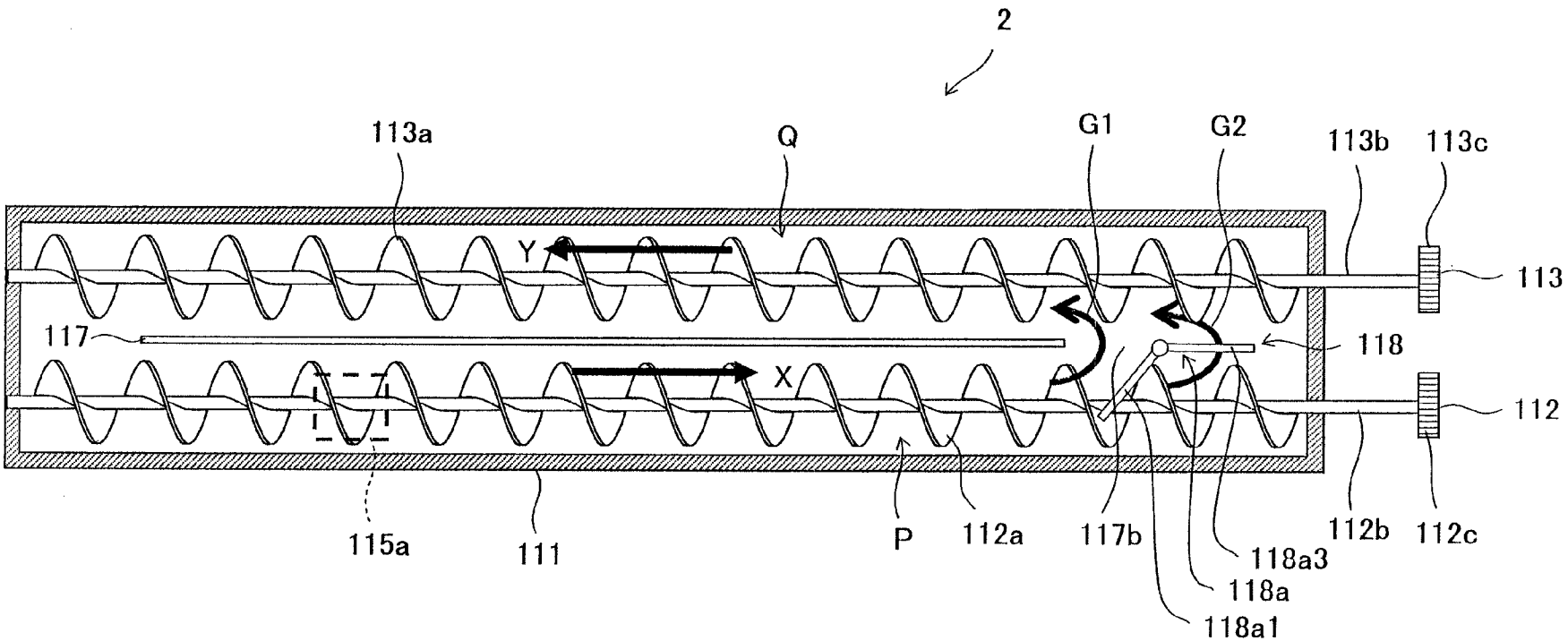
FIG. 6 is a sectional view cut along a plane A1-A2 in FIG. 4, for explaining the shutter member when the shutter member is open.
Figure 7:
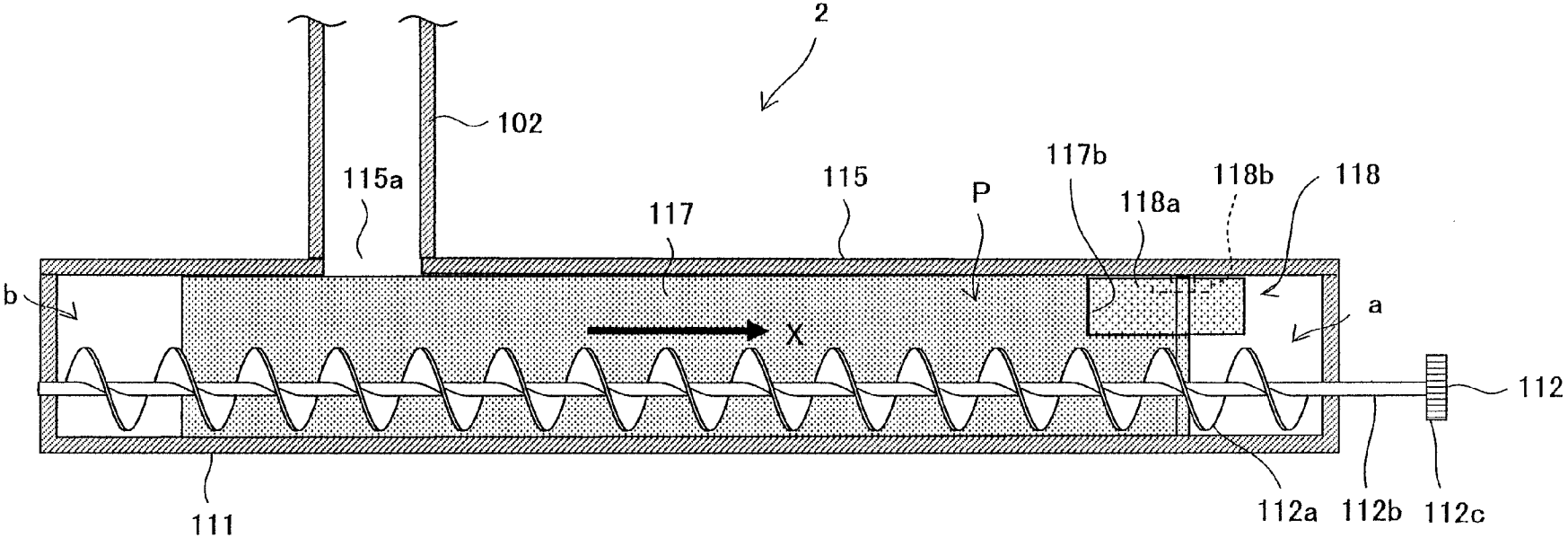
FIG. 7 is a sectional view cut along a plane B1-B2 in FIG. 4.

FIG. 4 is a sectional view showing the configuration of a developing device that constitutes the image forming apparatus according to the present embodiment. FIG. 5 is a sectional view cut along a plane A1-A2 in FIG. 4, for explaining a shutter member of a developer flow regulator as a part of the developing device when the shutter member is closed. FIG. 6 is an illustrative view for explaining the shutter member when the shutter member is open. FIG. 7 is a sectional view cut along a plane B1-B2 in FIG. 4.

As shown in FIG. 4, developing device 2 of the present embodiment has a developing roller 114 arranged in developing container 111 so as to oppose photoreceptor drum 3 and supplies toner from developing roller 114 to the photoreceptor drum 3 surface to visualize (develop) the electrostatic latent image formed on the surface of photoreceptor drum 3. This developing device includes a developer flow regulator 118 for regulating the flow of the developer moving inside developing container 111, as shown in FIGS. 5 and 6.

As shown in FIGS. 4 and 6, developing device 2 includes, further than developing roller 114, developing container 111, a developing container cover 115, a toner supply port 115*a*, a doctor blade 116, a first conveying member 112, a second conveying member 113, a partition (partitioning wall) 117, a toner concentration detecting sensor 119 and developer flow regulator 118.

Developing container 111 is a container for holding a dual-component developer that contains a toner and a carrier (which will be simply referred to hereinbelow as "developer"). Developing container 111 includes developing roller 114, first conveying member 112, second conveying member 113, developer flow regulator 118 and the like. Here, the carrier of the present embodiment is a magnetic carrier presenting magnetism.

Arranged on the top of developing container 111 is removable developing container cover 115. This developing container cover 115 is formed with toner supply port 115*a* for supplying unused toner into developing container 111.

Arranged in developing container 111 is partition 117 between first conveying member 112 and second conveying member 113. Partition 117 is extended parallel to the axial direction (the direction of each rotary shaft) of first and second conveying members 112 and 113. The interior of developing container 111 is divided by partition 117 into two sections, namely, a first conveying passage P with first conveying member 112 and a second conveying passage Q with second conveying member 113.

Partition 117 is arranged so that its ends, with respect to the axial direction of first and second conveying members 112 and 113, are spaced from respective interior wall surfaces of developing container 111. Hereby, developing container 111 has communicating paths that communicate between first conveying passage P and second conveying passage Q at around both axial ends of first and second conveying members 112 and 113. In the following description, as shown in FIG. 5, the communicating path formed on the downstream side with respect to the direction of arrow X is named first communicating path a and the communicating path formed on the downstream side with respect to the direction of arrow Y is named second communicating path b.

First conveying member 112 and second conveying member 113 are arranged so that their axes are parallel to each other with their peripheral sides opposing each other across partition 117, and rotated in opposite directions. That is, as shown in FIG. 5, first conveying member 112 conveys the dual-component developer in the direction of arrow X while second conveying member 113 conveys the developer in the direction of arrow Y, which is the opposite to the direction of arrow X.

As shown in FIG. 5, first conveying member 112 is composed of an auger screw formed of a first helical conveying blade 112*a* and a first rotary shaft 112*b*, and a gear 112*c*. Second conveying member 113 is composed of an auger screw formed of a second helical conveying blade 113*a* and a second rotary shaft 113*b*, and a gear 113*c* as shown in FIG. 5. First and second conveying members 112 and 113 are rotationally driven by a drive means (not shown) such as a motor etc., to agitate and convey the developer.

Developing roller 114 (FIG. 4) is a magnet roller which is rotationally driven about its axis by an unillustrated means, draws up and carries the developer in developing container 111 on the surface thereof and supplies toner from the developer that is supported on the surface thereof to photoreceptor drum 3. Developing roller 114 is arranged opposing, and apart from, photoreceptor drum 3 with a gap therebetween.

The developer conveyed by developing roller 114 comes in contact with photoreceptor drum 3 in the area where the roller surface and the drum surface become closest. This contact area is designated as a developing nip portion N. In this developing nip portion N, a developing bias voltage is applied to developing roller 114 from an unillustrated power source that is connected to developing roller 114, so that the toner is supplied from the developer on the developing roller 114 surface to the electrostatic latent image on the photoreceptor drum 3 surface.

Arranged close to the surface of developing roller 114 is a doctor blade (developer layer thickness regulating blade) 116.

Doctor blade 116 is a rectangular plate-shaped member that extends parallel to the direction of the axis (axial direction) of developing roller 114, and is disposed vertically below developing roller 114 and supported along its one axially extended side by developing container 111 so that its opposite longitudinal side is positioned a certain gap apart from the developing roller 114 surface. This doctor blade 116 may be made of stainless steel, or may be formed of aluminum, synthetic resin or the like.

Toner concentration detecting sensor 119 is provided on the bottom of developing container 111, at a position vertically under second conveying member 113 and attached with its sensor surface exposed to the interior of developing container 111.

Toner concentration detecting sensor 119 is electrically connected to an unillustrated toner concentration controller. This toner concentration controller rotationally drives toner discharger 122 in accordance with the measurement of toner concentration detected by toner concentration detecting sensor 119 so as to supply toner from toner discharge port 123 into developing container 111.

When the measurement of toner concentration from toner concentration detecting sensor 119 is determined to be lower than the set toner concentration level, the toner concentration controller sends a control signal to the driver for rotationally driving toner discharger 122 so as to rotationally drive toner discharger 122. Toner concentration detecting sensor 119 may use a general-purpose detection sensor. Examples include transmitted light detecting sensors, reflected light detecting sensors, magnetic permeability detecting sensors, etc. Of these, magnetic permeability detecting sensors are preferable.

The magnetic permeability detecting sensor is connected to an unillustrated power supply. This power supply applies to the magnetic permeability detecting sensor the drive voltage for driving the magnetic permeability detecting sensor and the control voltage for outputting the detected result of toner concentration to the controller. Application of voltage to magnetic permeability detecting sensor from the power supply is controlled by the controller. The magnetic permeability detecting sensor is a sensor that receives application of the control voltage and outputs the detected result of toner concentration as an output voltage. Since, basically, the sensor is sensitive in the middle range of the output voltage, the applied control voltage is adjusted so as to produce an output voltage around that range. Magnetic permeability detecting sensors of this kind are found on the market, examples including TS-L, TS-A and TS-K (all of these are trade names of products of TDK Corporation).

Now, conveyance of the developer in developing container 111 of developing device 2 will be described.

As shown in FIG. 1, the toner stored in toner supply device 22 is transported into developing container 111 through toner transport mechanism 102 and toner supply port 115*a* (FIGS. 4 and 5), and thereby supplied to developing container 111.

In developing container 111, first conveying member 112 and second conveying member 113 are rotationally driven by a drive means (not shown) such as a motor etc., to convey the developer. Specifically, in first conveying passage P, the developer is agitated and conveyed in the direction of arrow X by first conveying member 112 to reach first communicating path a. The developer reaching first communicating path a is conveyed through first communicating path a to second conveying passage Q.

On the other hand, in second conveying passage Q, the developer is agitated and conveyed in the direction of arrow Y by second conveying member 113 to reach second communicating path b. Then, the developer reaching second communicating path b is conveyed through second communicating path b to first conveying passage P.

That is, first conveying member 112 and second conveying member 113 agitate the developer while conveying it in opposite directions.

In this way, the developer is circulatively moving in developing container 111 along first conveying passage P, first communicating path a, second conveying passage Q and second communicating path b, in this mentioning order. In this arrangement, the developer is carried and drawn up by the surface of rotating developing roller 114 while being conveyed in second conveying passage Q, and the toner in the drawn up developer is continuously consumed as moving toward photoreceptor drum 3.

In order to compensate for this consumption of toner, unused toner is supplied from toner supply port 115*a* into first conveying passage P. The added toner is agitated and mixed with the previously existing developer in the first conveying passage P.

Next, developer flow regulator 118 will be described in detail with reference to the drawings.

Figure 8:
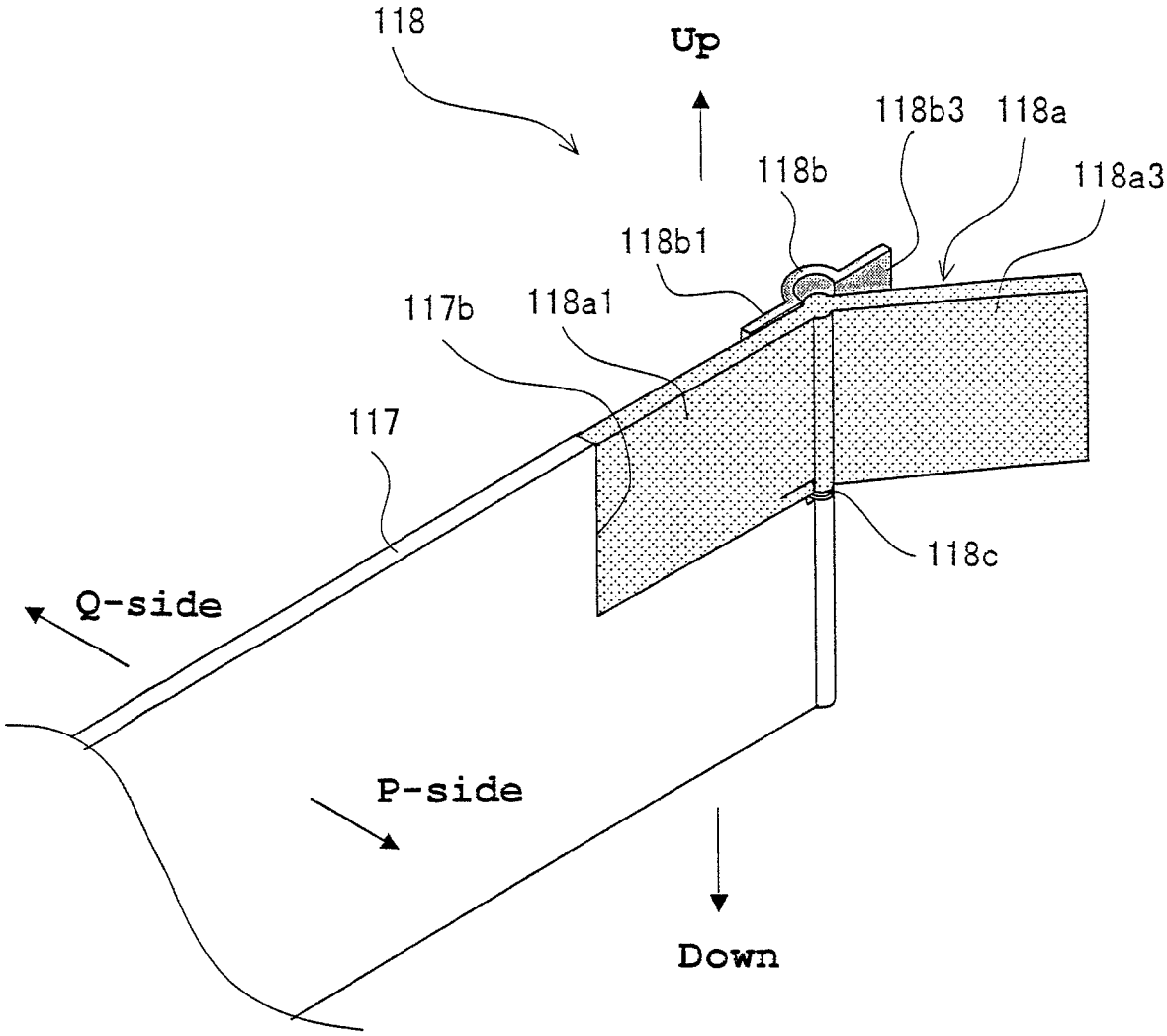
FIG. 8 is an enlarged perspective view showing the configuration of the developer flow regulator; and, FIG. 9 is an exploded perspective view showing the configuration of the developer flow regulator.
Figure 9:
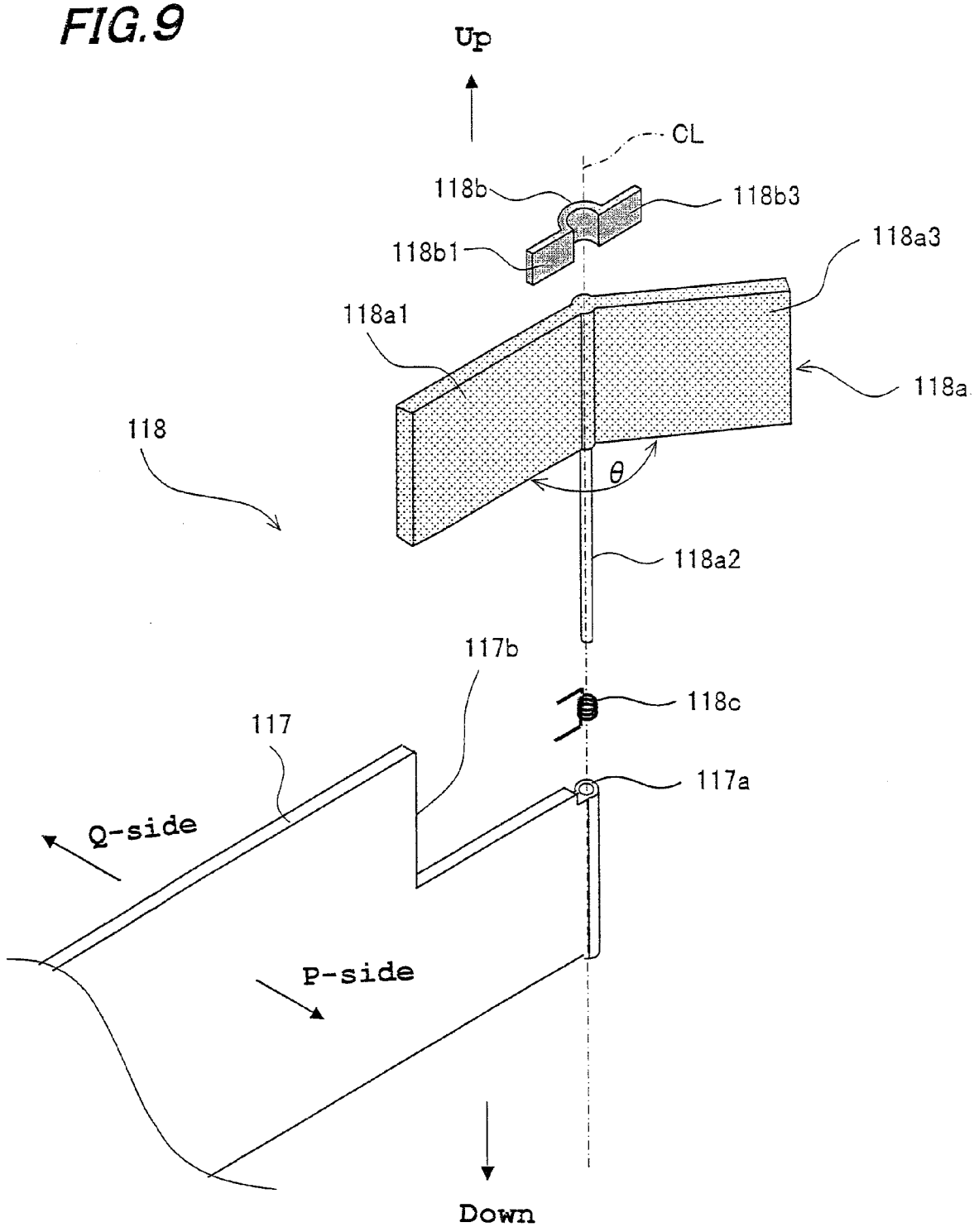

FIG. 8 is an enlarged perspective view showing the configuration of the developer flow regulator as a part of the developing device of the present embodiment. FIG. 9 is an exploded perspective view showing the configuration of the developer flow regulator.

In developing device 2, developer flow regulator 118 is constructed of, as shown in FIGS. 7, 8 and 9, a shutter member 118*a*, partition 117 having an upper opening 117*b* for passing the developer, a stopper 118*b* for limiting the movable range of shutter member 118*a* and a spring 118*c* that urges shutter member 118*a* in such a direction as to close upper opening 117*b*.

As shown in FIGS. 8 and 9, upper opening 117*b* is an opening that is cut out in the upper part of the end of partition 117 so as to have a substantially the same shape as a shutter plate 118*a*1.

As shown in FIGS. 8 and 9, shutter member 118*a* is formed of shutter plate 118*a*1 that opens and closes upper opening 117*b* of partition 117, a shutter member rotary shaft 118*a*2 (FIG. 9) that is pivotally supported and axially supports shutter plate 118*a*1 and a shutter shifting plate 118*a*3 that receives the flow of developer to shift the position of shutter plate 118*a*1.

Shutter member rotary shaft 118*a*2 is rotatably held on a bearing 117*a* (FIG. 9) formed at the end of partition 117. That is, partition 117 having bearing 117*a* functions as the supporter of shutter member 118*a*.

As shown in FIG. 9, the shutter member is formed of two planes, namely, shutter plate 118*a* and shutter shifting plate 118*a*3, which are radially arranged from the axis CL of shutter member rotary shaft 118*a*2 so as to be pivotal about shutter member rotary shaft 118*a*2. The angle θ formed between shutter plate 118*a*1 and shutter shifting plate 118*a*3 is preferably set to fall within the range from 90 degrees to 170 degrees.

If the angle θ formed between shutter plate 118*a*1 and shutter shifting plate 118*a*3 is smaller than 90 degrees, the force of the flow of developer acting on the shutter shifting plate is so strong that shutter member 118*a* is too ready to move rapidly. In contrast, if the angle θ formed between shutter plate 118*a*1 and shutter shifting plate 118*a*3 exceeds 170 degrees, shutter shifting plate 118*a*3 is too much tilted to the flow of developer to receive strong enough force from the developer. As a result, the action of the developer on shutter member 118*a* becomes weak so that shutter plate 118*a*1 moves sluggishly.

Stopper 118*b* is fixed to developing container cover 115 as shown in FIG. 7 so as to permit shutter member 118*a* to rotate within a predetermined range. That is, stopper 118*b* limits the movable range of shutter member 118*a*. Specifically, as shown in FIG. 8, stopper 118*b* is laid out in such a manner that shutter plate 118*a*1, when it is positioned to close upper opening 117*b*, abuts shutter plate abutment at 118*b*1 of stopper 118*b* while shutter shifting plate 118*a*3, when it is rotated a predetermined angle, abuts shifting plate abatement 118*b*3 of stopper 118*b*.

In the present embodiment, stopper 118*b* is disposed parallel to partition 117 so that shutter plate 118*a*1 and shutter shifting plate 118*a*3 will not jut out into the second conveying passage Q side, as shown in FIG. 8. In other words, stopper 118*b* is constructed such that when abutting stopper 118*b*, shutter plate 118*a*1 or shutter shifting plate 118*a*3 is positioned in alignment with partition 117.

As shown in FIG. 9, spring 118*c* is a helical torsion coil spring, and is fitted on shutter member rotary shaft 118*a*2. Spring 118*c* is hooked on the shutter plate 118*a*1 side at its one end and on the partition 117 side at the other end so that shutter plate 118*a*1 is urged to abut stopper 118*b* or shutter plate 118*a*1 is urged to close upper opening 117*b*, as shown in FIG. 8.

Next, conveyance of developer by developer flow regulator 118 in developing device 2 of the present embodiment will be described.

In developing device 2, the developer in developing container 111 is usually conveyed in the direction of arrow X in first conveying passage P, then is led to second conveying passage Q, passing through first communication path a. Thereafter, the developer is conveyed in the direction of arrow Y in the second conveying passage Q, and again returned to first conveying passage P, passing through second communication path b. In this way, the developer is circulatively conveyed in developing container 111. Under this usual condition, shutter plate 118*a*1 of shutter member 118*a* in developer flow regulator 118 is positioned such as to close upper opening 117*b* at the end of partition 117, as shown in FIG. 7.

Here, when the flow of the developer being conveyed in the X-direction in first conveying passage P becomes greater than the flow of the developer being fed through first communication path a to second conveying passage Q, part of the developer surface near first communication path a in first conveying passage P rises locally.

Then, shutter shifting plate 118*a*3 of shutter member 118*a*, as receiving the pressure from the flow of the developer that is locally building up in first conveying passage P, turns to the downstream with respect to the developer conveying direction. With this movement, shutter 118*a*1 turns to a position where upper opening 117*b* is opened.

Under this condition, the developer in first conveying passage P flows such that part of the upper layer of the developer (the upper layer developer G1) in first conveying passage P flows into the second conveying passage Q side, passing through upper opening 117*b* located upstream of first communication path a with respect to the developer conveying direction. Accordingly, the amount of developer flowing into second conveying passage Q becomes greater. At this time, the developer located in the bottom of first conveying passage P (the lower layer developer G2) passes under shutter shifting plate 118*a*3 and reaches first communication path a, then is led from first conveying passage P to second conveying passage Q as usual.

As a result, it is possible to lower the developer surface that has locally risen in first conveying passage P due to temporal stagnation of developer.

As configured as above, according to the present embodiment, provision of developer flow regulator 118 near first communication path a that connects between first conveying passage P and second conveying passage Q in developing device 2 used in image forming apparatus 100 enables increase of the flow of developer from first conveying passage P to second conveying passage Q by means of shutter member 118*a* when the height of the developer (developer surface) in first conveying passage P rises locally, hence making it possible to prevent stagnation of the developer near first communication path a, reduce the rise of the developer surface and keep the height of the developer surface uniform.

As a result, variation in the amount of developer scooped by the developing roller due to undulation of the developer surface can be inhibited, it is hence possible to realize high-quality image forming without causing any image density unevenness along the length of the developing roller.

Though in the present embodiment, developer flow regulator 118 is provided near first communication path a that connects between first conveying passage P and second conveying passage Q in developing device 2, the same configuration as that of developer flow regulator 118 may be provided near second communication path b that connects between second conveying passage Q and first conveying passage P. With this arrangement, it is possible to obtain the same effect as that of the aforementioned embodiment.

Further, according to the present embodiment, since developer flow regulator 118 is provided with shutter member 118*a* that opens and closes upper opening 117*b* formed in the upper end of partition 117, and the shutter member 118*a* is configured such that the angle formed between shutter plate 118*a*1 and shutter shifting plate 118*a*3 of shutter member 118*a* falls within the range of 90 degrees to 170 degrees, this configuration makes it possible to easily regulate the flow of developer flowing from first conveying passage P to second conveying passage Q.

Moreover, according to the present embodiment, since developer flow regulator 118 includes spring 118*c* that urges shutter plate 118*a*1 in such a direction as to close upper opening 117*b* and stopper 118*b* that limits the movable range of shutterplate 118*a*1, shutterplate 118*a*1 is gradually opened opposing the repulsive force of spring 118*c* in accordance with the flow of developer so as to increase the flow of developer by slow degrees. Also, since shutter shifting plate 118*a*3 is limited to move by the abutment of stopper 118*b*, it is possible to prevent shutter plate 118*a*1 from being excessively opened.

Though the above embodiment was described taking an example in which the image forming apparatus of the present invention is applied to image forming apparatus 100 shown in FIG. 1, as long as the image forming apparatus uses a developing device that includes a plurality of developer conveying passages in developing container 111 and is constructed so as to circulatively convey the developer inside the developing container 111 by provision of communication paths for allowing communication between these developing passages, the invention can be developed to any other image forming apparatus and the like, not limited to the image forming apparatus and copier described above.

Having described heretofore, the present invention is not limited to the above embodiment, various changes can be made within the scope of the appended claims. That is, any embodied mode obtained by combination of technical means modified as appropriate without departing from the spirit and scope of the present invention should be included in the technical art of the present invention.

What is claimed is:

1. A developing device comprising:

a developing container for storing a developer comprising a toner and a magnetic carrier;

first and second conveying passages that are formed in the developing container and sectioned by a partition;

first and second conveying members disposed inside the first and second conveying passages, respectively, to agitate and circulatively convey the developer inside the first and second conveying passages in opposite directions;

a developing roller that supplies the toner contained in the developer in the second developer conveying passage to a photoreceptor drum;

first and second communication paths that connect between the first and second conveying passages at both ends of the partition; and, a developer flow regulator that regulates the flow of developer from the first conveying passage to the second conveying passage or the flow of developer from the second conveying passage to the first conveying passage, in accordance with the relative height of the developer surface of the developer in the first and second conveying passage;

wherein the developer flow regulator comprises:

an upper opening formed in the upper part at the end of the partition;

a shutter member that opens and closes the upper opening, being adapted to change the size of the opening of the first communication path and/or second communication path, depending on the positioning thereof; and, a supporter for pivotally supporting the shutter member, the shutter member comprises:

a shutter plate that opens and closes the upper opening;

a shutter member rotary shaft that is pivotally supported and axially supports the shutter plate; and a shutter shifting plate that receives the flow of developer to shift the position of the shutter.

2. The developing device according to claim 1, wherein the shutter plate is arranged radially from the shutter member rotary shaft, and, the shutter shifting plate is arranged radially from the shutter member rotary shaft so as to form an angle of 90 to 170 degrees with the shutter plate.

3. The developing device according to claim 2, wherein the supporter is disposed at the end of the partition.

4. The developing device according to claim 2, wherein the developer flow regulator includes:

a spring that urges the shutter plate in such a direction as to close the upper opening; and, a stopper for limiting the movable range of the shutter plate.

5. An image forming apparatus for forming images with toner based on electrophotography, comprising:

a photoreceptor drum for forming an electrostatic latent image on the surface thereof;

a charging device for electrifying the surface of the photoreceptor drum;

an exposure device for forming an electrostatic latent image on the photoreceptor drum surface;

a developing device for forming a toner image by supplying toner to the electrostatic latent image on the photoreceptor drum surface;

a transfer device for transferring the toner image to a recording medium; and, a fixing device for fixing the transferred toner image to the recording medium, characterized in that the developing device employs the developing device defined in claim 1.

* * * * *